United States Patent [19]

Klementovich

[11] Patent Number: 4,981,391

[45] Date of Patent: Jan. 1, 1991

[54] INFLATABLE PORTABLE DAM FOR CONTAINMENT OF HAZARDOUS LIQUIDS

[76] Inventor: William L. Klementovich, 307 Hobart St., Gordon, Pa. 17936

[21] Appl. No.: 427,490

[22] Filed: Oct. 26, 1989

[51] Int. Cl.[5] ..... E02B 7/00; E02B 15/04

[52] U.S. Cl. ..... 405/52; 405/68

[58] Field of Search ..... 405/60, 63–66, 405/68, 70, 80, 91, 107, 115, 116, 128, 52, 270; 441/40

[56] References Cited

U.S. PATENT DOCUMENTS

| | | | |
|---|---|---|---|
| 4,356 | 1/1846 | Day | 441/40 |
| 3,268,925 | 8/1966 | Serra | 441/40 |
| 3,635,032 | 1/1972 | Desty et al. | 405/68 |
| 3,653,084 | 4/1972 | Hartman | 441/40 |
| 4,083,070 | 4/1978 | Martin | 441/40 |
| 4,750,894 | 6/1988 | Nealey | 441/40 |
| 4,799,821 | 1/1989 | Brodersen | 405/115 |

*Primary Examiner*—Randolph A. Reese
*Assistant Examiner*—John Ricci

[57] ABSTRACT

An inflatable portable dam apparatus for the containment and/or collection of hazardous liquids leakage and spills. The dam will prevent damage to the environment, reduce clean-up costs, and render the product reusable.

1 Claim, 1 Drawing Sheet

INFLATABLE PORTABLE DAM FOR CONTAINMENT OF HAZARDOUS LIQUIDS

BACKGROUND—FIELD OF THE INVENTION

This invention relates in general to an inflatable liquid containment device and especially to an inflatable portable method and apparatus for containment and/or collection of hazardous liquids leakage or spills.

BACKGROUND—DESCRIPTION OF PRIOR ART

Heretofore whenever leakage or spills of hazardous liquids has occurred one of the major concerns is control and/or containment of the liquid to prevent environmental contamination. If the leakage or spill is not controlled or confined the hazardous liquid will inevitably spread and contaminate areas of the environment that were previously uncontaminated. It is therefore desirable to contain and/or control such a leakage and spills as close to their origin as possible, thus preserving the environment and facilitating easier and less costly clean-up.

Although fire departments and hazardous materials handling teams (Haz-Mat teams) are usually adequately trained to contain and/or control hazardous liquid leakage and spills, present normal operating procedures require use of organic diking substances such as sand or earth, or the use of absorbant materials to confine and control the leakage or spill. This process contaminates the environment, the diking material, and the product involved in the leakage or spill. At the end of the incident it then becomes necessary to remove the contaminated environment, the material used for diking, and the product involved and to dispose of them in a designed manner and at an approved location. A very costly and labor intensive operation.

Such prior art addressed control and confinement of hazardous liquids leakage and spills beyond their original point of entry into the environment, thus allowing contamination to continue and enlarge, resulting in extensive and costly incidents. Therefore a new useful method and apparatus is needed to contain and/or collect hazardous liquids leakage and spills as close to their point of origin as possible thus overcoming the problems of extensive environmental damage, costly clean-up, and non-reusable product.

OBJECTS AND ADVANTAGES

Accordingly I claim the following as my objects and advantages of the invention: to provide an apparatus which is inflatable with air and deflatable, to provide an apparatus which is portable, to provide and apparatus that is reusable, to provide an apparatus that can be stored in a small amount of space, to provide an apparatus that can be built to a desired size, to provide an apparatus which requires a minimum of skill and training to use.

In addition I claim the following objects and advantages: to provide a method to collect hazardous liquids at their point of entry into the environment, to provide a method to collect hazardous liquids which will render them reuseable, to provide a method to reduce clean-up and disposal costs from a hazardous liquids leakage or spill, to provide a method and apparatus to eliminate the use of sand, earth, and absorbant materials for control of a hazardous liquids leakage or spill, to provide a method and apparatus to prevent extensive environmental damage from a hazardous liquids leakage or spill.

DESCRIPTION OF THE DRAWING FIGURES

FIG. 1 shows a perspective frontal view of the deployed dam containing hazardous liquids.

FIG. 2 is an enlarged fragmentary sectional view taken along line 2—2 of FIG. 1 showing the formed tubular structure attached to the bottom according to the invention.

DRAWING REFERENCE NUMERALS

10 hazardous liquids
12 air insertion device
14 tubular structure
16 bottom
18 angular intersection
20 overlap of 14

DESCRIPTION OF THE DRAWINGS

FIG. 2 also shows the attachment by means, preferably thermal heat sealing, of the tubular structure 14 to the said bottom 16 sheet of flexible material. Approximately two inches of said bottom 16 is then folded back upon the overlap 20 of said tubular structure 14 and attached by means, preferably thermal heat sealing, thus producing a water tight apparatus.

OPERATION OF THE INVENTION

Figure 1:
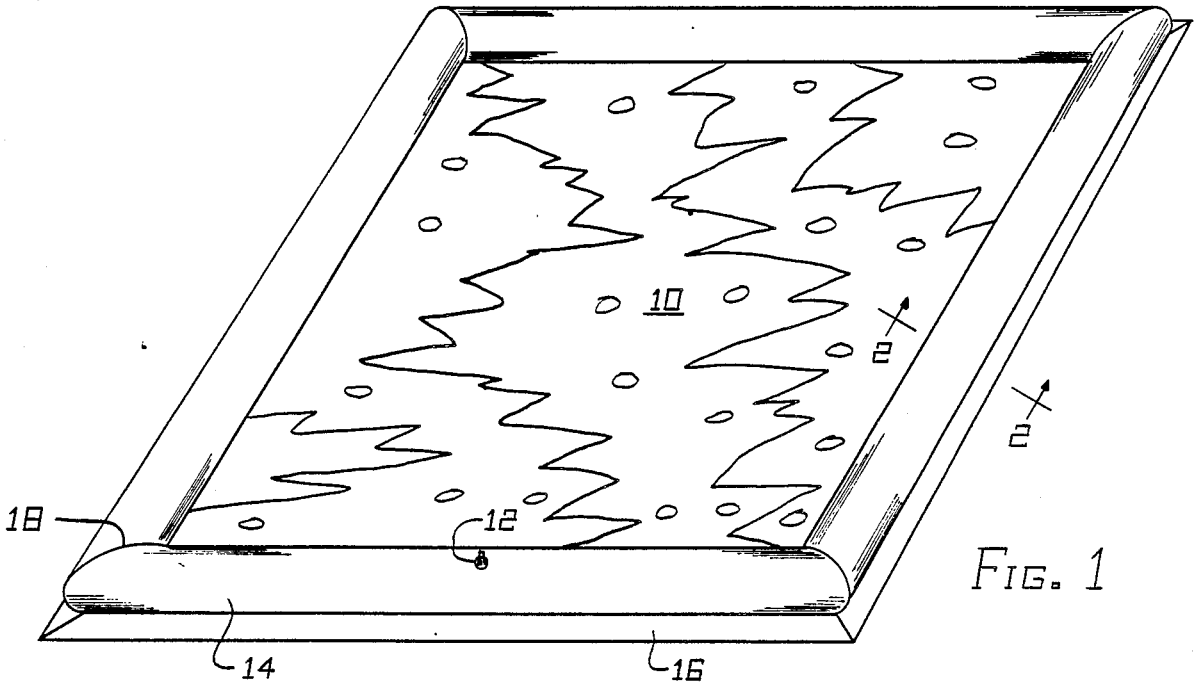
FIG. 1 shows particularly the embodiment of the invention as deployed, containing a hazardous liquid 10. The dam comprises a bottom 16 sheet of flexible synthetic material with a plurality of edges. Attached to said bottom 16 by means, preferably thermal heat sealing, is a continuous tubular structure 14. Said tubular structure 14 consists of a plurality of panels of said flexible material containing two straight parallel edges and two ends. Into one said panel of flexible material is installed an air insertion device 12. The end of one said panel of flexible material is attached by means, preferably thermal heat sealing, to the end of the next panel along its entirety. Each end is in turn mated to the next, resulting in a continuous piece of flexible material with angular intersections 18. Said continuous piece of flexible material then formed into tubular structure 14 by overlaping 20 of the straight paralled edges approximately three inches and attaching said edges by means, preferably thermal heat sealing.
Figure 2:
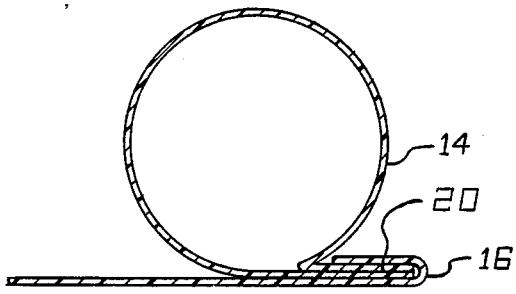
FIG. 2 shows the resultant tubular structure 14.

The dam is stowed in a deflated mode, preferably folded in such manner as to require as little storage space as possible. To deploy the dam it is first unfolded such that the bottom 16 is touching the ground and the deflated tubular structure is on top with the air insertion device 12 accessible. Compressed air is then introduced into the air insertion device 12 from any available source such as a fire department Self-Contained Breathing Apparatus cylinder or Cascade System. Sufficient air is introduced through the air insertion device 12 until the tubular structure 14 obtains a circular shape along its entirety. The inflated dam is then positioned under a hazardous liquid 10 leak. Alternately, the leaking container can be placed inside the perimeter of the tubular structure, thereby containing the hazardous liquid 10. At the conclusion of the incident, the hazardous liquid 10 can be removed from the dam in a reuseable form, the dam properly decontaminated, deflated and stored for reuse. Thus the hazardous liquid is reused, does not enter the environment, and clean-up and disposal is swift and less costly. The above mentioned specificities should not be construed as limitations on the scope of the invention, rather as its preferred embodiment. Those skilled in the art will envision other possibilities of the invention. Variations may include, but may not be limited to, dimensions, shape, and materials.

Specifically, the dimensions of the bottom 16 and the tubular structure 14 can be increased or decreased as required for greater or lesser capacity. The diameter of the tubular structure 14 can be altered to vary the capacity. Additional material can be allocated between the tubular structure 14 and the bottom 16 thus allowing the tubular structure 14 to float up and away from the bottom 16 increasing capacity, and rendering usefulness on uneven or sloped surfaces.

The shape of the dam can be altered to accommodate unorthodoxed locations such as triangular. Another tubular structure can be intragrated above the existing tubular structure 14 thereby increasing capacity of the dam.

Construction materials can be substituted to limit its usefulness to containment of a specific hazardous liquid, or conversely to expand its adaptability to a wide range of hazardous liquids. Accordingly the reader is requested to determine the scope of the invention by the appended claims and their legal equivalents and not by the examples which have been given.

I claim:

1. A method of collection and containment of hazardous liquids using an inflatable portable apparatus of the type comprising:

a bottom sheet of flexible material containing a plurality of edges, a plurality of separate panels of flexible material equal in number to the plurality of edges of said bottom sheet of flexible material, said separate panels of flexible material to have two straight parallel edges and two ends, the end of one panel of flexible material attached by means, preferably thermal heat sealing, to the end of the next panel of flexible material, thereby forming a continuous piece of flexible material with a plurality an angular intersections, said continuous piece of flexible material formed into tubular shape by overlapping and preferably thermal heat sealing the straight parallel edges of each panel along their entirety, thereby forming a continuous air tight tubular structure with angular intersections, the overlap of said tubular structure attached to said bottom sheet of flexible material along its entirety by preferably thermal heat sealing, thereby forming a water tight connection, affixed in the tubular structure a device for the insertion and removal of compressed air, said method comprising the steps of:

removing the deflated stowed apparatus from storage;

deploying the apparatus such that the bottom is located beneath the tubular structure;

inflating said tubular structure pneumatically through the air insertion device until a continuous circular shape is obtained by the tubular structure along its entirety; and positioning said apparatus such that a hazardous liquid can be collected and contained within the perimeter of the apparatus.

* * * * *